US005549735A

United States Patent [19]

Coppom

[11] Patent Number: 5,549,735

[45] Date of Patent: Aug. 27, 1996

[54] ELECTROSTATIC FIBROUS FILTER

[76] Inventor: Rex R. Coppom, 939 Buffalo Ct., Longmont, Colo. 80501

[21] Appl. No.: 257,729

[22] Filed: Jun. 9, 1994

[51] Int. Cl.[6] ..... B03C 3/155

[52] U.S. Cl. ..... 96/63; 95/78; 96/68; 96/88

[58] Field of Search ..... 96/59, 63, 66, 96/68, 70, 88, 69; 95/63, 78; 55/279; 422/22, 121, 906, 907

[56] References Cited

U.S. PATENT DOCUMENTS

| | | | |
|---|---|---|---|
| 2,377,391 | 6/1945 | White | 95/78 |
| 3,073,094 | 1/1963 | Landgraf et al. | 96/66 |
| 3,392,509 | 7/1968 | Pelosi, Jr. | 96/66 |
| 3,581,462 | 6/1971 | Stump | 96/66 X |
| 3,915,672 | 10/1975 | Penney | 95/81 |
| 3,999,964 | 12/1976 | Carr | 96/59 |
| 4,193,779 | 3/1980 | Hencke | 55/290 |
| 4,210,429 | 7/1980 | Golstein | 55/279 |
| 4,251,234 | 2/1981 | Chang | 96/77 X |
| 4,265,641 | 5/1981 | Natarajan | 96/99 X |
| 4,265,643 | 5/1981 | Dawson | 55/473 X |
| 4,290,788 | 9/1981 | Pittman et al. | 55/481 X |
| 4,376,642 | 3/1983 | Verity | 55/279 X |
| 4,978,372 | 12/1990 | Pick | 96/88 X |
| 5,055,118 | 10/1991 | Nagoshi et al. | 96/88 |
| 5,133,788 | 7/1992 | Backus | 96/66 X |
| 5,330,559 | 7/1994 | Cheney et al. | 95/63 |
| 5,364,458 | 11/1994 | Burnett et al. | 96/68 X |

FOREIGN PATENT DOCUMENTS

| | | | |
|---|---|---|---|
| 53-112578 | 10/1978 | Japan | 96/66 |

OTHER PUBLICATIONS

"Switch to a Perfect Climate;" Information booklet on the Honeywell F50 Electronic Air Cleaner, Honeywell, Inc., 1985 Douglas Drive N., Golden Valley, MN 55402 50–7054E, Mar. 1992, 6 pages.

Information booklet on the Universal Electrostatic Adjustable Furnace/AC Filter; Rolox Ltd., Inc. P.O. Box 4131, Kansas City, MO 64101, ; 2 pages, Undated.

Lawrence Livermore National Laboratory, "Electric Air Filtration: Theory, Laboratory Studies, Hardware Development, and Field Evaluations," published Sep. 1983.

*Primary Examiner*—Richard L. Chiesa
*Attorney, Agent, or Firm*—Duft, Graziano & Forest, P.C.

[57] ABSTRACT

The particle collection efficiency of a fibrous filter is significantly increased by imposing a high voltage potential on electrodes placed on either side of the filter. This creates a strong electrostatic field across the filter which electrically enhances the fiber's particle collection ability. The electrostatic field strength, and particle collection efficiency, increase with the voltage employed to establish the electrostatic field. An insulated electrode as the front electrode in combination with a conductive electrode as the rear electrode enables a very high electrical potential to be imposed on the electrodes without resulting in arcing between electrodes. Pre-charging of dust particulates with the same polarity as the insulated electrodes further increase collection efficiency without resulting in a charge buildup in front of the electrodes or a blocking of airflow by particles collecting on the electrodes.

10 Claims, 8 Drawing Sheets

ELECTROSTATIC FIBROUS FILTER

FIELD OF INVENTION

The present invention relates to purifying air by electrifying conventional fibrous filters in such a way so as to increase efficiency while avoiding arcing and preventing the neutralization of the filter's electrostatic forces by the buildup of oppositely charged pollutants.

BACKGROUND OF THE INVENTION

In 1992 over 1.1 million air purifiers were sold in the United States alone. This market has arisen due to the adverse health effects experienced by a growing number of people from breathing indoor air of poor quality, or indoor air contaminated by pollutants from outdoors. Indeed, four of the top ten health problems in the U.S. are respiratory related: #1 Sinusitis, #5 Allergies, #7 Bronchitis, and #8 Asthma. Nevertheless, less than 2% of the nearly 94 million households currently own an air purifier.

Air purifiers sold to date have been characterized by a number of deficiencies. They either do not produce the quality of air required or they are noisy and expensive to operate (filter replacement, energy, etc.). This lack of quality products has created a clear market need for the introduction of a superior air purifier at a reasonable cost which resolves problems of indoor air quality and its serious health effects.

Very few improvements have been made in either the technology or design of existing air purifiers in recent years. Units currently on the market essentially utilize one of two methods for air purification. One method incorporates mechanical filters which consist of a flat, or pleated, mat of fibers contained in a supporting frame. The second category of air cleaner uses electronic, or electrostatic, technology. Both methods have drawbacks. Mechanical filters, for example, become breeding grounds for bacteria and other germs. In addition, increasing the efficiency of mechanical filters comes at a significant cost. Electronic air cleaners, on the other hand, can become producers of ozone and are limited in their ability to remove all types of impurities from the air.

The important factors in determining the potential health hazard of particulate/gaseous pollutants are:

1. The degree of toxicity of the pollutant.
2. The mass of the pollutant inhaled (amount of exposure).
3. The size of the particle (the smaller the size, the greater is its potential for causing damage because of where it deposits in the respiratory tract).
4. The "state of health" of the respiratory tract (i.e. its ability to purge itself of inhaled particulate pollutants).
5. The nature of the "particulate", especially microorganisms (germs, virus, bacteria, molds, etc.).

Basically we can't change the toxicity of particulate or gaseous pollutants. Therefore, in order to reduce the health hazard of indoor air we need to (a) remove as many particulates as possible . . . especially very small (submicron) size particles which are so detrimental healthwise, (b) reduce gaseous pollutants,(c) eliminate airborne micro-organisms (germs, viruses, etc.), and (d) restore a more natural level of negative ions to the indoor environment . . . ions which stimulate the natural clearing of the respiratory tract.

Therefore, the performance of all air purifiers is measured by: the efficiency with which they remove particulate . . . including those of sub-micron size, their effectiveness in removing gaseous pollutants, the amount of clean air they can provide to the user, and their germicidal effect.

Generally speaking, in engineering any air purification system the fundamental performance criteria should be to achieve over 99% particle removal efficiency at very low airflow resistance.

However, as most air purifiers collect pollutants their airflow rate and/or their efficiency decreases significantly. This, in turn, results in dramatically lower overall air cleaning benefit.

Low airflow resistance is important because the typical fan or blower has great difficulty in moving a high volume of air against resistance. Generally, as resistance increases the volume of air moved decreases proportionally. Fans that are capable of moving a large amount of air against a high resistance are (1) significantly more expensive, (2) much noisier and (3) use more energy to operate.

The various existing air cleaners fall into two general categories: Mechanical Filters (media type) and Electronic Air Cleaners.

For media type filters airflow presents a real dilemma: to increase efficiency, the number of fibers in their media has to be increased; but as fibers are added the resistance also increases.

This was the main impetus behind the design of the electronic air cleaner. Since the unit's airstream faces only the leading edges of a series of plates which make up the "electronic cell", there is very little resistance to airflow. Unfortunately, other aspects of this technology have drawbacks which, in overall performance, negate the benefit of low airflow resistance.

A "Hybrid" filter was produced when it was discovered that certain electrical forces can greatly enhance particle removal efficiency of a fiber media. The Lawrence Livermore National Laboratories are credited with providing the scientific verification of this concept. Several versions of what are now termed "electrostatic" filters have appeared on the market, but again, while they represent a step forward, their overall performance has still left much to be desired.

A mechanical filter generally consists of a flat, or pleated, mat of fibers (the "filter media") contained in a supporting frame. This type of filter removes particles from the air passing through it by collecting them as they impact on individual fibers or are too large to pass between fibers. The percentage of particulate trapped determines the filter's overall efficiency, e.g. 4%, 20%, 50%, or 85%, etc. The typical "furnace filter" will be of low resistance (very few fibers) with very low efficiency . . . 4% to 9%. A "hi-tech filter", the HEPA (High Efficiency Particle Arrestor) filter, will be a high resistance filter (many fibers, densely packed) with a high particle removal efficiency (99+%).

Obviously, the smaller the space between the individual fibers, the smaller the size of particle that can be trapped. Unfortunately, as the openings get smaller the resistance to airflow also increases. It now takes much more energy to push the air through the filter. The reason a very open, but inefficient, filter is used in home furnaces is because the furnace's blower would not be able to move the amount of air needed for proper heating, or cooling, against the resistance of a more dense (more efficient) filter. As a high efficiency (HEPA) mechanical filter loads with particulate, resistance increases further while the amount of air passing through the filter decreases dramatically. This results in a significant lowering of overall air cleaning performance/benefit.

| ADVANTAGES: | DISADVANTAGES: |
|---|---|
| LOW-EFFICIENCY MECHANICAL FILTERS: | |
| 1. Low initial and replacement cost. | 1. Low overall particle removal efficiency. |
| 2. Low resistance to air flow. | 2. Very low efficiency (virtually none) in the sub-micron size. |
| 3. Easy to install. | 3. None to low germ removal. |
| 4. Disposable. | 4. No removal of gaseous pollutants. |
| 5. Easy replacement. | |
| HIGH EFFICIENCY MECHANICAL FILTERS: | |
| 1. High particle removal efficiency. | 1. High initial and replacement cost. |
| | 2. High resistance to airflow (=noisy blower). |
| | 3. Easily clogged by cigarette smoke. |
| | 4. Only some germs removed. |
| | 5. No gaseous pollutant removal. |
| | 6. Airflow rate drops with loading. |
| | 7. No germicidal effect. |

The second category of air cleaner is that of the electronic, or electrostatic, air cleaner. These are subdivided into two different methods of operation: Powered (electronic) and non-powered (electrostatic).

Powered units draw air in through a front section which electrically charges the incoming particles with a positive charge, and then passes these particles between a series of plates which are alternately positive and ground. The positive particles are repelled away from the positive plates over to the grounded plates where they collect. Because of their very open configuration, such units naturally have a very low resistance to airflow. Non-powered units have a filter media whose plastic fibers are either permanently charged by heating and cooling them in an electric field (electret media), or have the property of becoming electrostatically "charged" by the friction of the air passing over them.

Another type of electrostatic air cleaner is the negative ion generator. These units produce a large quantity of negative ions into the room air which attach themselves to particles in the air and cause them to precipitate out, or to be attracted to nearby grounded surfaces (walls, etc.). Negative ion generators do not have to rely on airflow as part of their cleaning process and are, therefore, totally noiseless in their operation. Unfortunately, many of the charged particles attach to walls and other surfaces near the ion generator . . . resulting in a "dirtying" of these surfaces which is sometimes not easily cleanable and very often requires repainting of the surface.

POWERED ELECTRONIC AIR CLEANERS

ADVANTAGES:

1. Low resistance to airflow.
2. No filter media to dispose of.

DISADVANTAGES

1. High initial cost.
2. High maintenance.
3. Can produce ozone.
4. Noisy on high setting.
5. Efficiency decreases rapidly as unit gets dirty.
6. Low germ removal.
7. No gaseous pollutant removal.
8. No germicidal effect.

NON-POWERED ELECTRONIC (ELECTROSTATIC/ELECTRET) AIR CLEANERS

ADVANTAGES:

1. Moderate airflow resistance.
2. Moderate initial cost.
3. Easy replacement.
4. Relatively high efficiency.

DISADVANTAGES:

1. Charged pollutants neutralize the fiber's charge; resulting in loss of efficiency.
2. Above average expense to replace filter.
3. Only moderate germ removal.
4. No gaseous pollutant removal.
5. No germicidal effect.

NEGATIVE ION GENERATORS

ADVANTAGES:

1. Totally quiet.
2. High efficiency.
3. Provides negative ion enriched air.
4. No filter to change.
5. Minimal maintenance.
6. Low operating cost.

DISADVANTAGES:

1. Plating of pollutants on room surfaces (walls, etc.).
2. Limited area of coverage.
3. Limited germ removal.
4. Only moderate removal of gaseous pollutants.
5. Slow removal rate.
6. No germicidal effect.

NEGATIVE ION GENERATORS PLUS POSITIVE COLLECTOR

ADVANTAGES:

(As above)

Positive Collector does attract a portion of charged pollutants to it, reducing the plating effect somewhat.

A summary of the most relevant prior art follows below.

U.S. Pat. No. 2,377,391 (1945) to White discloses one of the earliest inventions regarding electronic air cleaners. A method and apparatus of charging suspended particles in air is taught. Once charged, the particles are removed by a separate precipitator. Broadly speaking, the invention comprises increasing the strength of the electric field between a discharge and a non-discharge electrode in the portion of the field adjacent the non-discharge electrode. This may advantageously be effected by providing a previous, non-discharging auxiliary or grid electrode member between the discharge electrode and non-discharge electrode, and maintaining a substantially greater potential difference per unit of spacing between the auxiliary electrode and non-discharge electrode than between the discharge electrode and the auxiliary electrode. The auxiliary electrode is maintained at a potential between that of the discharge electrode and that of the non-discharge electrode, so that the polarity of the field between the discharge electrode and the auxiliary electrode is the same as that of the field between the auxiliary electrode and the non-discharge electrode.

U.S. Pat. No. 3,915,672 (1975) to Penney discloses an electrostatic precipitator having parallel grounded plate electrode dust collectors. High voltage corona wires are located between the plate electrodes. They charge the dust particles which are then drawn to the plate electrodes. The corona wires are pulsed in order to prevent back-corona which otherwise occurs due to the high resistivity of the dust accumulation on the plate electrodes.

U.S. Pat. No. 4,193,779 (1980) to Hencke discloses a mechanical filter having a vortex chamber for removing industrial dust particles.

U.S. Pat. No. 4,210,429 (1980) to Golstein discloses room air purifier having a charcoal filter and germ killing ultraviolet lamps.

U.S. Pat. No. 4,251,234 (1981) to Chang discloses a furnace discharge air cleaner. Electrostatic precipitation is improved with turbulence.

U.S. Pat. No. 4,265,641 (1981) to Natarajan discloses a needle to plate dustionizer. A collector plate is used which must be cleaned.

U.S. Pat. No. 4,265,643 (1981) to Dawson discloses an electrostatic room air purifier. State of the Art ionizing plates charge the dust to a positive state. Then downstream in the air flow a discardable corrugated aluminum grounded collector plate is used.

U.S. Pat. No. 4,290,788 (1981) to Pittman et al. discloses an in-duct home furnace electrostatic air cleaner. It can be easily installed. It was a series of parallel positive collector plates and negative collector plates as is known in the art. Dust particles are ionized and then collected on a negative collector plate. These negative collector plates must be cleaned regularly or else they lose their ability to collect dust.

U.S. Pat. No. 4,376,642 (1983) to Verity discloses a combination fibrous filter and electrostatic precipitator. An exposed negative ion source ionizes all the ambient air and dust particles. Air flow carries the ionized particles to an oppositely charged shredded plastic membrane filter. Each filter fiber has a rectangular shape and contains a high voltage gradient at their corners. Each dust particle is charged either plus or minus by one fiber. Then the charged dust particle is drawn to the downstream fiber at the corner having an opposite charge.

U.S. Pat. No. 5,055,118 (1991) to Nagoshi et al. discloses an electrostatic dust collector. A first positive ionization electrode positively ionizes the dust. Then the dust passes into a chamber having a pair of uninsulated electrodes at a high voltage, separated by an insulation layer. Coulomb's law causes the dust to collect on the grounded electrode, thereby neutralizing the charge of the dust particles. The dust only collects on the grounded electrode due to special gaps in the laminate which prevents dust build-up on other components. The theory is that dust accumulation on only the grounded electrode does not cause significant deterioration of the electric charge due to the neutralization by the dust particles. However, it is clear that cleaning of the negative electrodes is necessary to maintain air flow.

The Honeywell® F50 Electronic Air Cleaner also uses the known positive and negative collector plate technology. A 95% cleaning efficiency is claimed. However, the plates must be periodically cleaned by insertion in a dishwasher or an equivalent chemical bath.

Rolox Ltd. manufactures a Universal electrostatic Filter. Following is the theory of operation behind this type of filter. The filter is constructed of a series of open weave plastic materials which have different electrostatic properties. The friction of the air passing over the surface of the first layer is supposed to charge the plastic with a positive polarity of charge and furthermore, in the process, airborne particles passing through the plastic web also become charged. Now the air, and particles continue on and pass over, and through, the next layer of plastic material . . . which by its properties charges the opposite, or negative. The negative charge on this layer attracts the positively charged particles out of the air. However, the friction of the air passing over these plastic surfaces only generates very weak electrostatic charges. The electrostatic collection effect is proportionate to the strength of the electric field resulting from the different charges. (This filter tests out at only 14% efficiency.)

The most relevant prior art was published in September 1983 by Lawrence Livermore National Laboratory in a manuscript entitled, "Electric Air Filtration: Theory, Laboratory Studies, Hardware Development, and Field Evaluations." The U.S. Department of Energy (DOE) sponsored research on providing an alternative to the HEPA type filters by utilizing filters of electrically enhanced fibers. The report states than an electrically enhanced filter is an ideal candidate for removing sub-micron airborne particles. Compared to a conventional fibrous filter, an electrified filter has a much higher efficiency, a significantly lower pressure drop at the same level of particle loading, and a greatly extended filter life.

The preferred model of filter created by Livermore had an uninsulated electrode placed in front of a fibrous filter. Next after the fibrous filter was placed a grounded uninsulated electrode. The individual fibers became polarized along their lengths. They thereby collected either positive or negative dust particles all along their length on both sides. The efficiency of filtration and longevity of the fibrous filter were excellent. The efficiency of the filter is dependent upon the strength of the electric field established between the electrodes. This strength of the electric field increases with higher electrode voltages.

However, the high voltages necessary to achieve maximum efficiency resulted in arcing between the electrodes with a subsequent loss of electric field strength (Livermore at page 101). The Livermore models sparked at 12 Kv. Efforts to utilize insulated electrodes failed due to the neutralization of their charge by oppositely charged particles collecting on or migrating to their surfaces. Thus, the insulated electrodes stopped the arcing, but their performance deteriorated drastically as opposite charges built up and neutralized their electric field (Livermore at page 103).

However, persistent arcing between the electrodes stopped the model from becoming commercially feasible. Efforts at insulating the electrodes failed due to the neutralizing effect of oppositely charged dust building up on the surfaces of the insulated electrodes. Thus, the insulated electrodes stopped the arcing, but lost effectiveness as collected charges neutralized their electric charge.

The present invention solves both the problems of arcing and the neutralization of an insulated electrode's charge and electric field. The major breakthrough over Livermore is the addition of insulation on only one electrode. This permits electric voltages ranging from 12–50 Kv. These higher voltages create higher filtration efficiencies. Usually the first electrode is insulated. The system then works as follows. First the air is pre-charged. Next the air passes by the insulated electrode which is charged the same as the pre-charger. Thus, almost no dust collects on the first electrode because of like charges repelling each other. Charges of polarity opposite to that of the insulated electrode will collect on the electrode's surfaces but they cannot interfere with the electrode's charge/field because they are quickly neutralized by oppositely charged ions from the precharger. Next the air passes through the charged fibers. The dust is collected on the fibers. The air then passes by the uninsulated second electrode and into the ambient air. Charges from the precharger will separate from the dust which remains in the filter. The charges will migrate along fiber surfaces to the uninsulated electrode where they are neutralized.

SUMMARY OF THE INVENTION

The main object of the present invention is to provide a fibrous air filter of highly increased efficiency which requires minimum maintenance and is not subject to arcing or the deterioration of its performance due to neutralization of its electrifying forces. This is accomplished by electrifying the fibers and preventing arcing by the use of single insulated electrode and an uninsulated electrode.

Another object of the present invention is to pre-charge incoming air to the same charge as the first insulated electrode which charges the fibers. Thus, most of the ionized particles are repelled by the first electrode and collected in the fibers.

Another object of the present invention is to collect the ionized dust early throughout the more open surface fibers thereby minimizing the clogging of the filter, and reducing the replacement cycle.

Yet another object of the present invention is to eliminate dendrite formation on the fibrous filters by attracting the ionized dust tightly and evenly along all of the fibers.

Still yet another object of the present invention is to kill germs by electric fields as they collect in the fibers.

Other objects of this invention will appear from the following description and appended claims, reference being had to the accompanying drawings forming a part of this specification wherein like reference characters designate corresponding parts in the several views.

It is the goal of the present invention to overcome the deficiencies of the powered electrostatic filters which uses conductive electrodes. It is a further goal to achieve an increase in particle collection efficiency, while prolonging filter life of a conventional fibrous filter. This includes:

(1) How to increase electrode voltage, in order to increase efficiency, without resulting in arcing.

(2) How to prevent electrode arcing due to high humidity.

(3) How to use non-conductive electrodes to achieve #1 & #2 above, without incurring opposite charge buildup on the electrodes due to migrating charges which will neutralize their electrostatic field. And, how to prevent this charge buildup even when there is compression of the filter media due to high airflow.

(4) How to pre-charge particles without: (a) having them collect on the front electrode, (b) their contributing to a charge buildup on the electrodes, and (c) without their building a path of ionization through the filter which would result in a short circuit of the electrodes.

SOLUTION:

(1) Combine the utilization of an insulated electrode as the first (or front) electrode with;

(2) A conductive electrode as the second (or rear) electrode which sandwiches a fibrous filter; and (3) Charge incoming particles by ions of the same polarity as the insulated electrode (+ or −).

Utilizing an insulated electrode as one of the two necessary electrodes allows a very high electrical potential to be applied to either the insulated electrode, or to both electrodes, while eliminating the possibility of arcing between the two electrodes (either due to the voltage jumping the gap between electrodes, or due to high humidity or ionization building a conductive pathway between the electrodes). This higher voltage results in an increase in electrostatic field strength with a subsequently higher polarizing effect on the filter's fibers and incoming particles. Therefore, particle collection efficiency is significantly higher . . . even of particles in the submicron size range.

The pre-charging of particles can now be effectively utilized because with the insulated electrode being the first, or front, electrode, the pre-charging of particles by ions of the same polarity as the electrode will repel these particles from the electrode and so prevent particle buildup from blocking the movement of other particles into the filter's interior.

Charges of opposite polarity to that of the insulated electrode (and the polarity of the pre-charging ions) will still migrate to the area in front of (or on) the insulated electrode, but they will now be neutralized by the incoming oppositely charged ions from the pre-charging section. This eliminates the charge buildup in front of the insulated electrode responsible for a loss of field strength and particle collection efficiency.

This will still be the case even if airflow through the filter compresses the media away from contact with the surface of the insulated electrode, since it is no longer necessary for the media to have contact with the electrode in order to bring about neutralization of the buildup of opposite charge.

Driven by the strong electrostatic field between the electrodes, ions from the pre-charging section which are collected on the filter's fibers will migrate along the surface to the conductive electrode (grounded, or of opposite polarity) where they will be neutralized. Again preventing any charge buildup which would diminish the field strength between the electrodes.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
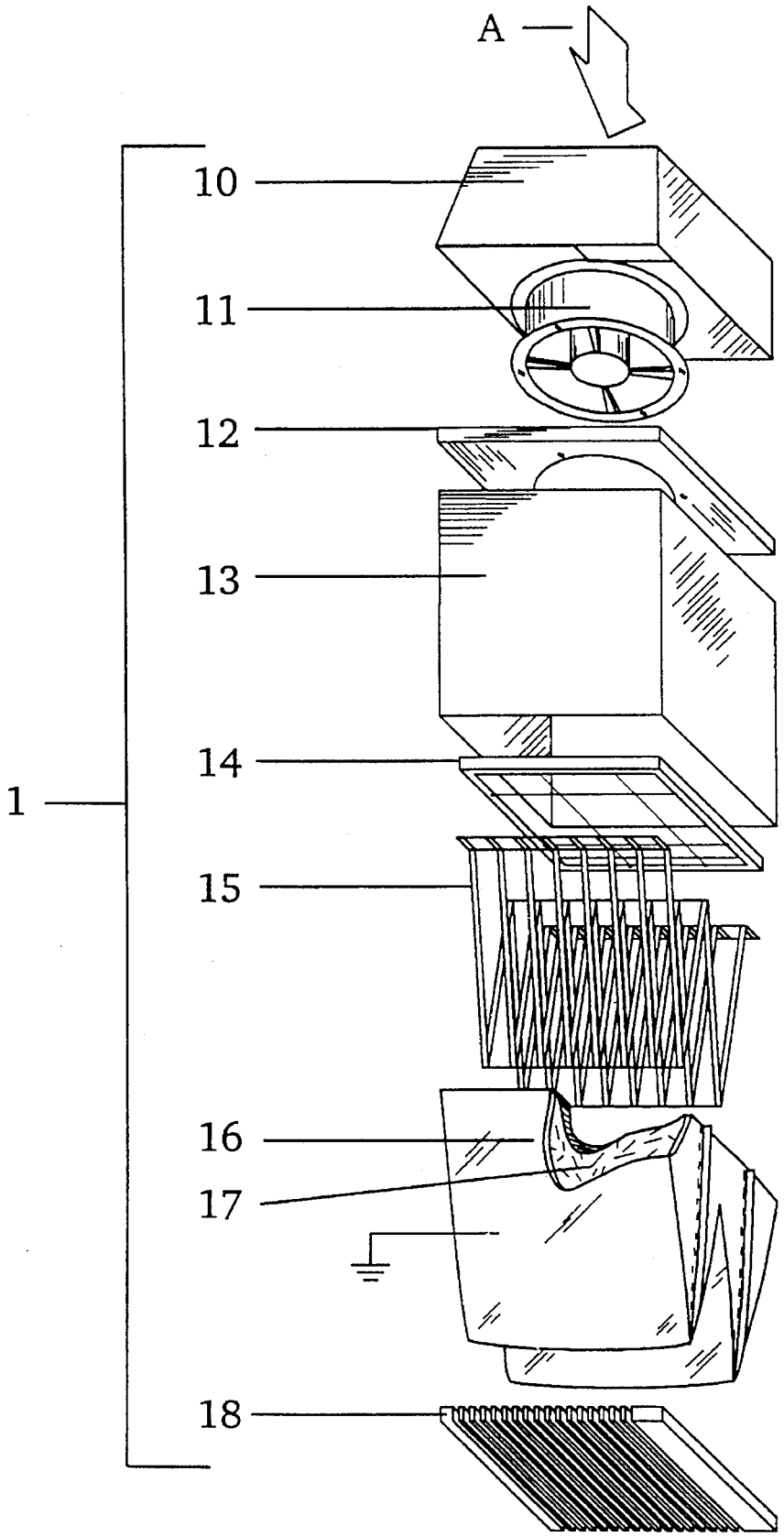
FIG. 1 is a top perspective exploded view of the preferred embodiment of a room air purifier.

Referring first to FIG. 1 the room air purifier 1 comprises a main housing 13 which houses a rear housing 10, a blower 11, and a blower mounting plate 12. The first step to purify incoming air A is to send it past the pre-charging grid 14 which ionizes the dust particles to a negative state in a known manner using 10K–50K volts DC. Next the air passes through an insulated high voltage grid 15 which is also charged negatively with the same 10K–50 KV D.C. Next the air passes through a conventional fibrous filter 17, thereby capturing both ionized and polarized dust particles and micro organisms. Next the air passes through the grounded activated carbon electrode 16. The cleansed air then exits the outlet grill 18. It should be noted that an equivalent embodiment would pre-charge the air positive and reverse the polarity of the charging electrodes 15, 16.

Figure 2:
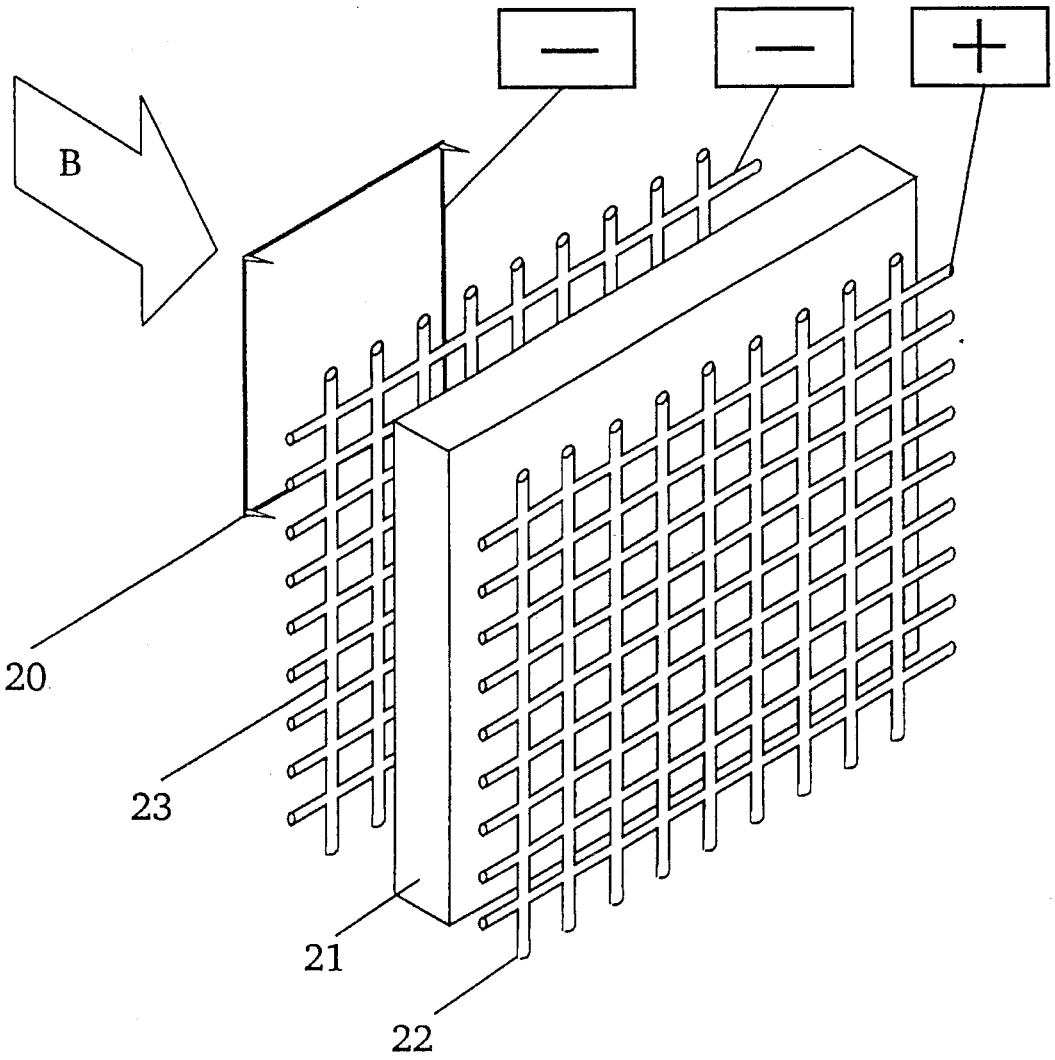
FIG. 2 is a top perspective view of the operational elements of the invention.

Referring next to FIG. 2 an electrically equivalent arrangement as that in FIG. 1 is shown. Input air B first is charged negative by pre-charger 20. The first charging electrode 23 is insulated and charged negatively. The fibrous filter 21 is electrified by the positively charged uninsulated electrode 22. Once again, an equivalent result can be achieved by pre-charging positively and reversing the polarity of electrodes 22, 23. In either configuration electrode 22 could be ground.

Figure 4:
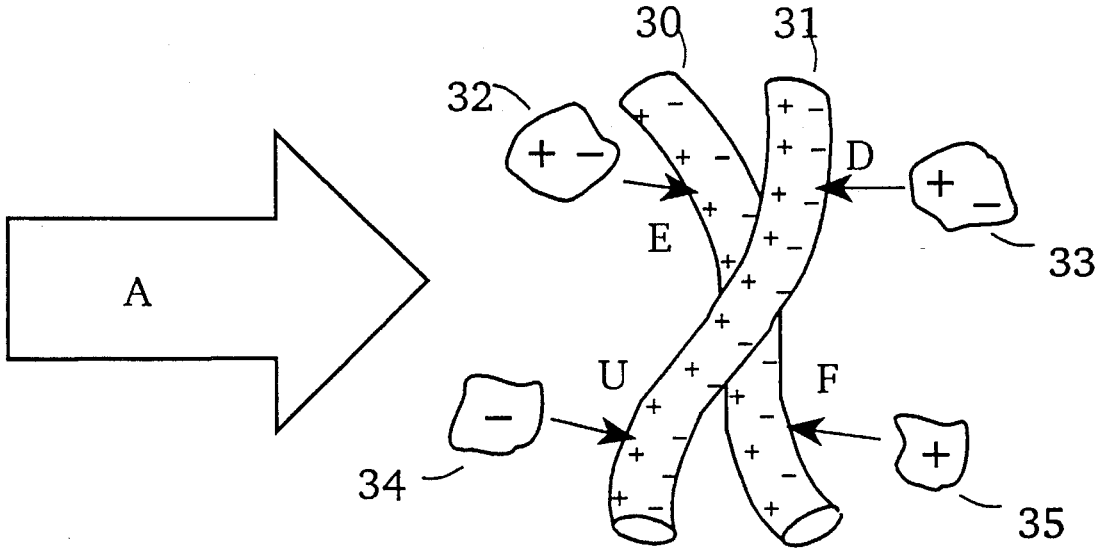
FIG. 4 is a front plan view of two electrified fibers.

FIG. 4 shows how the dust particle 34 was pre-charged to a negative ionization from the negative pre-charger of FIGS. 1, 2. Fiber 31 has been electrified longitudinally with the positive side upstream from the negative side. Particle 34 by Coulomb's Law is collected to the positive upstream side of fiber 31 at arrow U. Polarized particles 32, 33 are attracted to the opposite charged sides of fibers 30, 31 at surfaces E, D. Positive ion particle 35 is attracted to the opposite field of surface F. These naturally occurring positive ion particles 35 would be rare. Thus, the system collects all dust particles regardless of their charged or uncharged state all along the longitudinal axes of the countless fibers.

In summary for FIGS. 1, 2 which are the preferred embodiments, the dust particles are ionized to a negative state. Then they are repelled by a like-charged first electrode. Any rare positive ions may attract to the first electrode. Practically all the dust is collected along the electrified fibers. Almost no dust is left to clog the last electrode. The fibrous filter lasts much longer than uncharged fibrous filters because the dust collects tightly and evenly all along the fibers rather than in a layer in the front of the fibrous filter. Furthermore, the formation of dendrites is prevented. Additionally, germs are killed by filter's electro-static forces.

Figure 3:
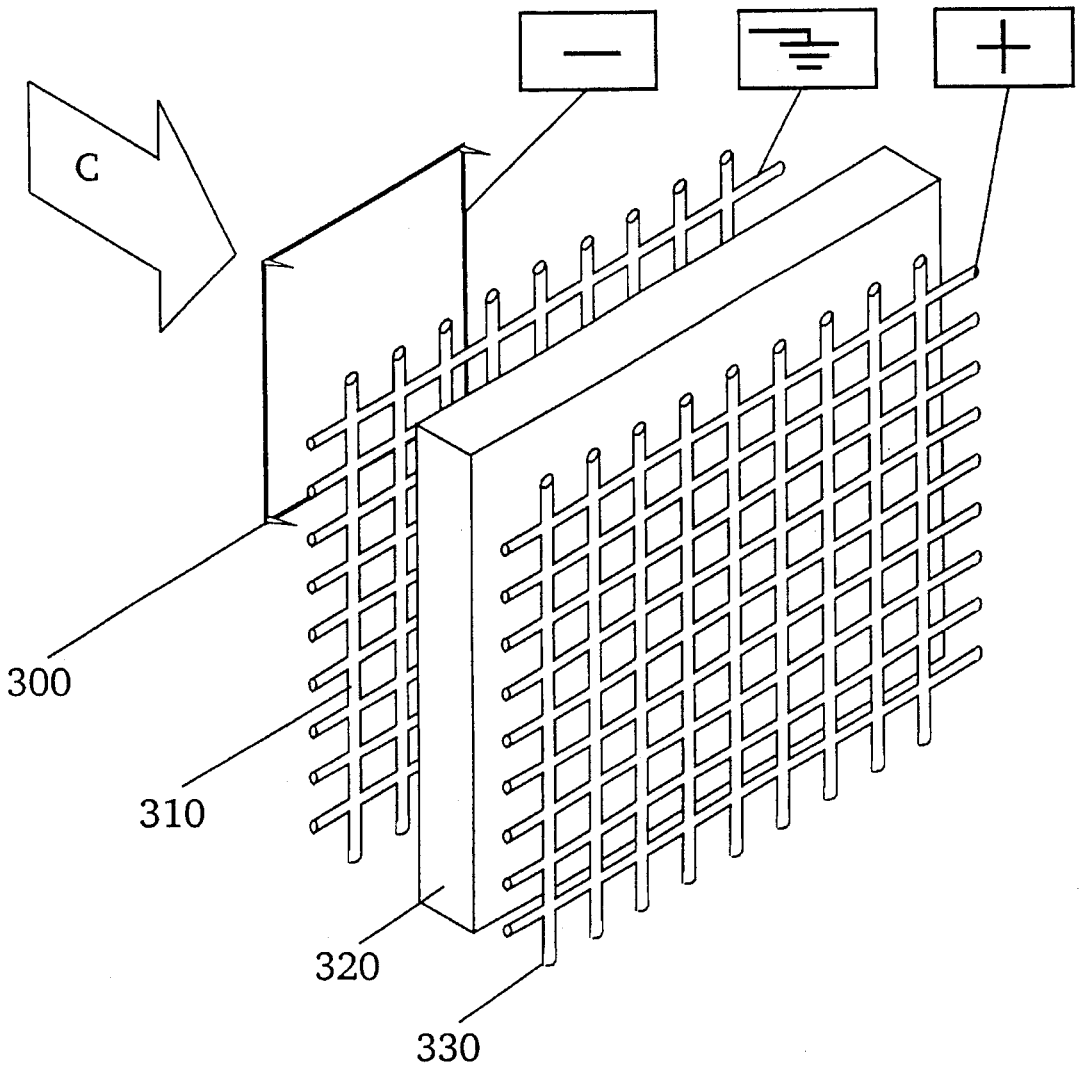
FIG. 3 is a top perspective view of the operational elements of an alternate embodiment of the invention.

Referring next to FIG. 3 is an inefficient embodiment. The grounded insulated first electrode 310 acts to collect virtually all polarities (+, –, ±) of dust particles. The pre-charger 300 could be either negative or positive. The second electrode 330 could be either negative or positive. The fibrous filter 320 only collects what the ground electrode 310 misses. Some applications could choose this configuration for various reasons including the desirability of washing, collecting, and analyzing dust samples from ground electrode 310.

Figure 5:
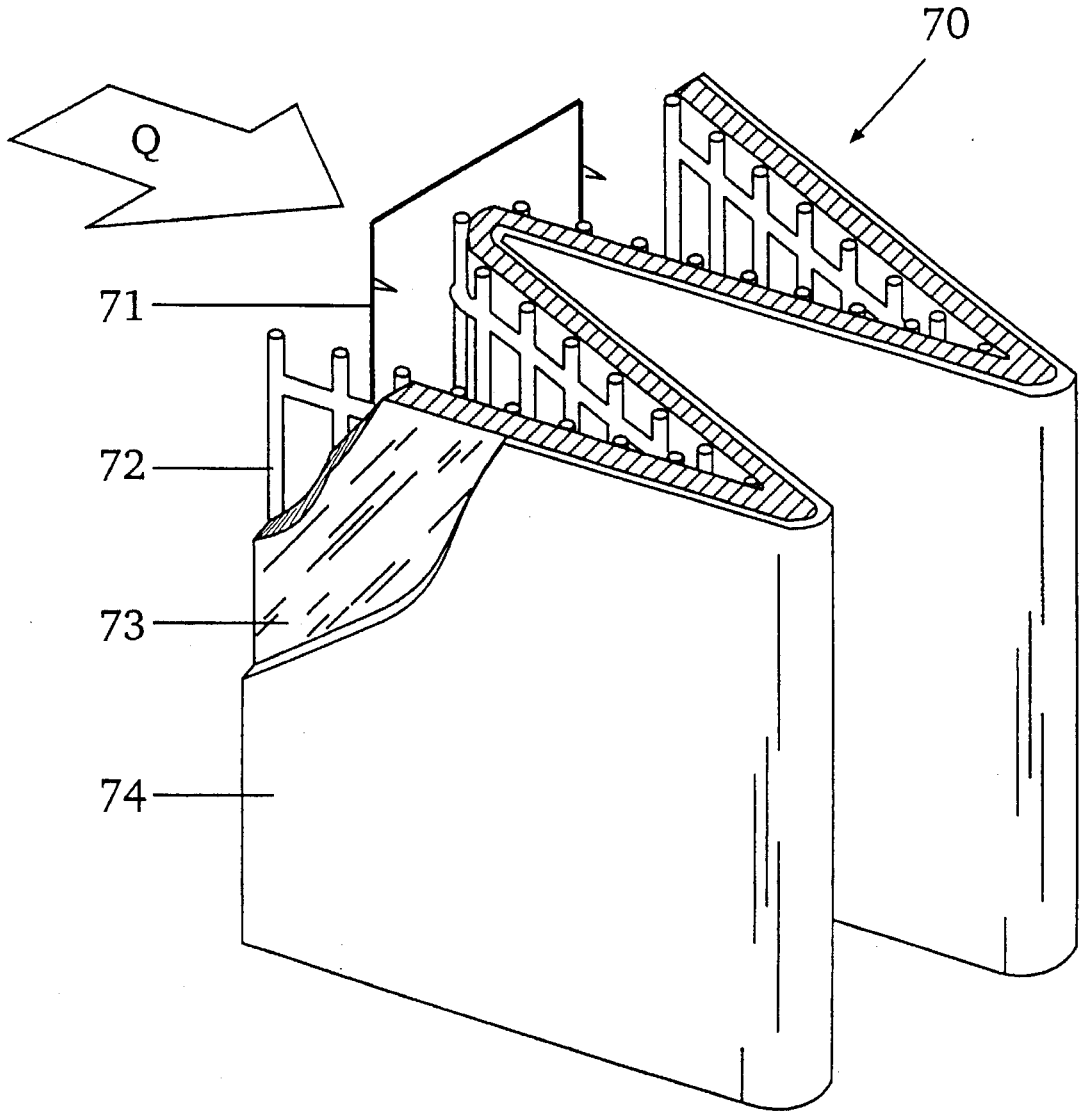
FIG. 5 is a top perspective view of a pleated filter using an added activated carbon fibrous layer.

Referring next to FIG. 5 the airflow Q passes the pre-charger 71 of pleated filter 70. A first insulated electrode 72 has the same charge as the pre-charger. A fibrous filter media 73 is electrified by an uninsulated activated carbon electrode 74 having an opposite charge to electrode 72 or a ground connection and the first electrode.

Figure 6:
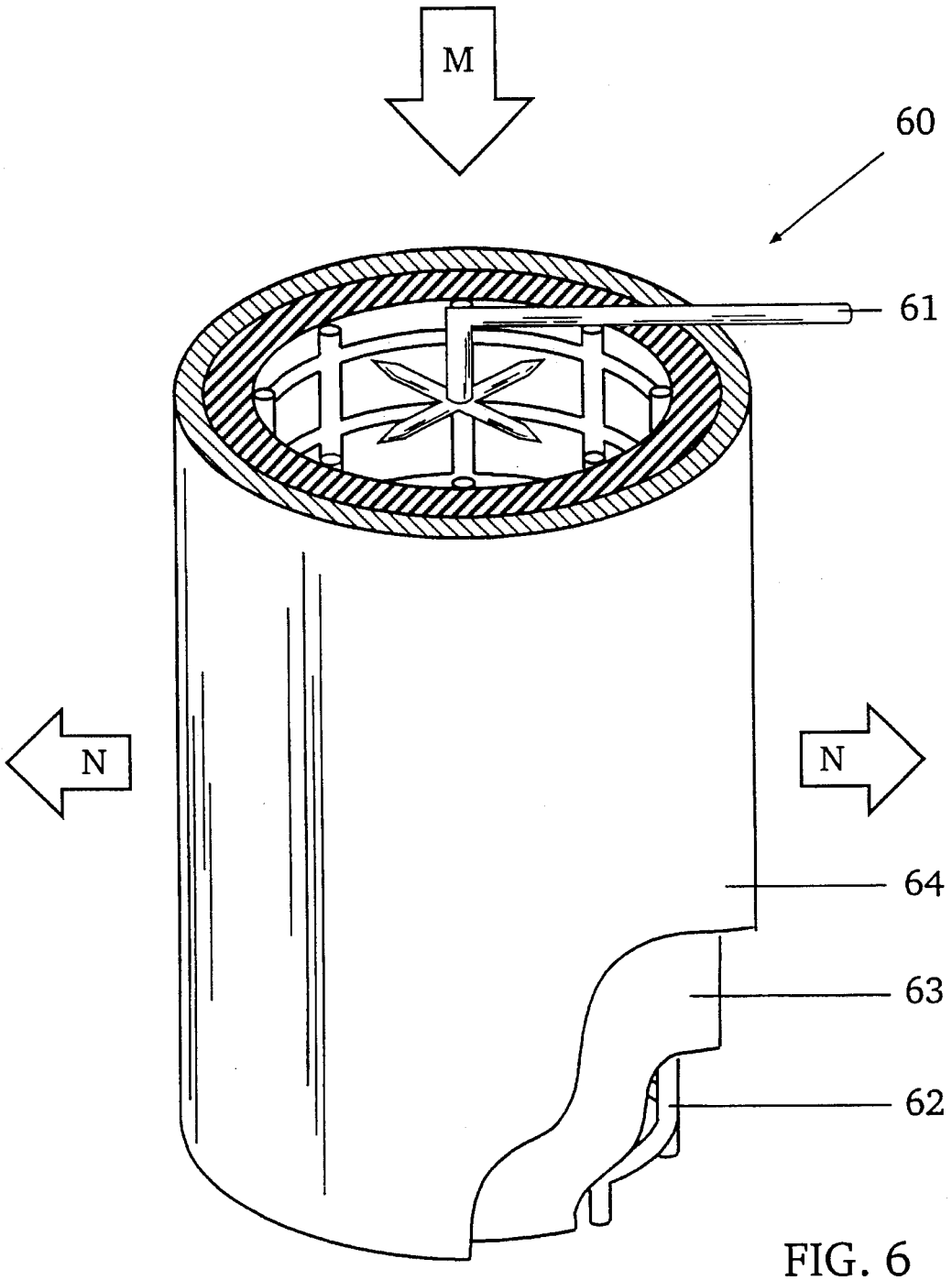
FIG. 6 is a top perspective view of a cylindrical embodiment.

Referring lastly to FIG. 6 a cylindrical filter 60 has intake air M pass through pre-charger 61, then insulated first electrode 62, then fibrous filter 63, then second electrode 64. Pre-charger 61 and first insulated electrode 62 are the same charge. Second electrode 64 is grounded or of opposite polarity to electrode 62. Output air is indicated by N.

A final embodiment (not shown) eliminates all pre-chargers. This results in about a 20% reduction in efficiency. However, dust buildup on the electrodes quickly neutralizes the electric field.

Known in the art are various ways to insulate the insulated electrodes. These methods include dipping or spraying a wire or a stamped metal strand; extruding or injection molding an insulator simultaneously with a wire; and piecing together injection molded insulator halves around a wire.

EXAMPLES

FILTER EFFICIENCY TESTS:

The attached tests were conducted in a test chamber constructed to ASHRAE standards for the testing of HEPA grade filters utilizing DOP particles and an airflow rate of 100 cubic feet per minute (cfm).

Air within the system was first filtered through HEPA filters and then DOP particles were generated into this class air. In order to determine particle removal efficiency, the particle concentration and sizes were measured by a Climet CL-6 300 Laser Particle Counter prior to the air entering the test filter and after leaving the test filter. This particle counter provides measurements in the size ranges of 0.19 micron to 0.3 micron, 0.3 to 0.5 micron, 0.5 to 1 micron, 1 to 3 microns, 3 to 5 microns, and particles greater than 5 microns in. It also gives a total of all particles together.

Each test consisted of four separate sets of "before and after" filter particle counts. The data is given as "Particle Size", "Particle count upstream" (before the filter), "Particle count downstream" (after the filter), and "Efficiency" (in percentage of particles removed). Also given, are the total number of particles "Upstream" and "Downstream", and overall particle removal efficiency.

The object of the testing was to determine if a low-cost, low-resistance, open type filter media (which typically also has a low particle removal efficiency) could be turned into a high efficiency filter by pre-ionizing particles before they entered the filter and by establishing an electrostatic field across the filter media to charge and polarize the fibers.

Several tests on the filter media without any ionization, or electric field, demonstrated the typical overall efficiency of just the filter media by itself to be between 12% and 23%.

The "uncharged" filter media's removal was best on particles larger than 1 micron in size; and worst on sub-micron size particles.

With ionization and an electrostatic field, the overall efficiency of the filter media was improved to 99.65%. There is only a percentage point difference between the removal efficiency for larger particles and that for the sub-micron sized particles. The laser particle counter was unable to measure particles smaller than 0.19 micron in size, but it is expected that the removal efficiency would remain as high for particles down to 0.01 micron in size.

These tests demonstrate that a low-cost filter media, which has low resistance to airflow (due to its open structure and low fiber content), can be turned into a high efficiency filter by the incorporation of particle ionization and electrostatic fields established across the media.

Subsequent examination of the test filter media also shows that the particle buildup on, and within, the filter media is very different for the charged and uncharged media. The pattern of particle buildup on/within the charged media would mean that its "life" (the time until the dirt buildup causes too much resistance to airflow will be approximately three times that of the uncharged media . . . even though the charged media collects many times more particulate pollutants than the uncharged.

TEST ONE

Manville Technical Center — Reinforcements & Filtrations
Filter Efficiency Test
using Climet CL-6300 Laser Particle Counter
07/23/91 — 14:43

Test Parameters:

| | | | |
|---|---|---|---|
| Test Number | 2953 | Filter Media | COP-GP-3/4 |
| Particles | | Filter Backing | |
| Filter Air Flow | 100 cfm | Machine | |
| Pressure Drop | .095 in Wg | Job Number | |
| Temperature | 83.6° F. | Roll | |
| Rel Humidity | 45.6% | Lane | |
| Counter Air Flow | .099 cfm | Year Manuf | 91 |
| Sample Time | 00:30 min:sec | Day Manuf | |
| Delay Time | 10 awx | Shift Manuf | |
| Misc Info | NO CHARGE | | |
| Counting Mode | Differential | Cycles | 4 |

Test Results:

| Particle Size um | Particle Count upstream | (sum of cycles) downstream | Efficiency % |
|---|---|---|---|
| .19–.3 | 26972 | 23050 | 14 |
| .3–.5u | 27452 | 23130 | 15 |
| .5–1u | 32225 | 26048 | 19 |
| 1–3u | 4490 | 3513 | 21 |
| 3–5u | 94 | 50 | 46 |
| >5.00u | 10 | 14 | −39 |
| total | 91243 | 75805 | 16 |

Figure 7:
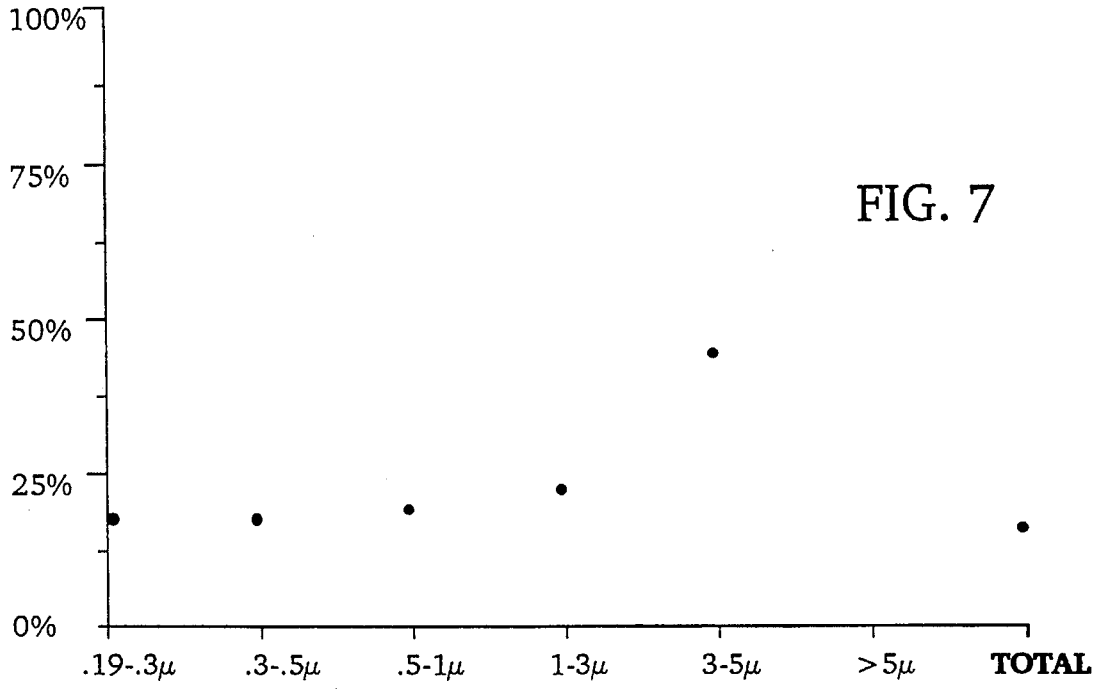
FIG. 7 is a chart of a filter efficiency test using an UNCHARGED fibrous filter.

These table results are shown in FIG. 7. In summary a conventional fibrous filter was used with no electrostatic field.

TEST TWO

Manville Technical Center — Reinforcements & Filtrations
Filter Efficiency Test
using Climet CL-6300 Laser Particle Counter
07/23/91 — 15:18

Test Parameters:

| | | | |
|---|---|---|---|
| Test Number | 2957 | Filter Media | COP-GP-3/4 |
| Particles | | Filter Backing | |
| Filter Air Flow | 100 cfm | Machine | |
| Pressure Drop | .090 in Wg | Job Number | |
| Temperature | 83.6° F. | Roll | |
| Rel Humidity | 45.2% | Lane | |
| Counter Air Flow | .099 cfm | Year Manuf | 91 |
| Sample Time | 00:30 min:sec | Day Manuf | |
| Delay Time | 10 sec | Shift Manuf | |
| Misc Info | CHARGE + IONIZATION | | |
| Counting Mode | Differential | Cycles | 4 |

Test Results:

| Particle Size um | Particle Count upstream | (sum of cycles) downstream | Efficiency % |
|---|---|---|---|
| .19–.3 | 26118 | 160 | 99 |
| .3–.5u | 27519 | 64 | 99 |
| .5–1u | 33369 | 88 | 99 |
| 1–3u | 5145 | 9 | 99 |
| 3–5u | 94 | 0 | 100 |
| >5.00u | 10 | 0 | 100 |
| total | 9225 | 321 | 99.65 |

Figure 8:
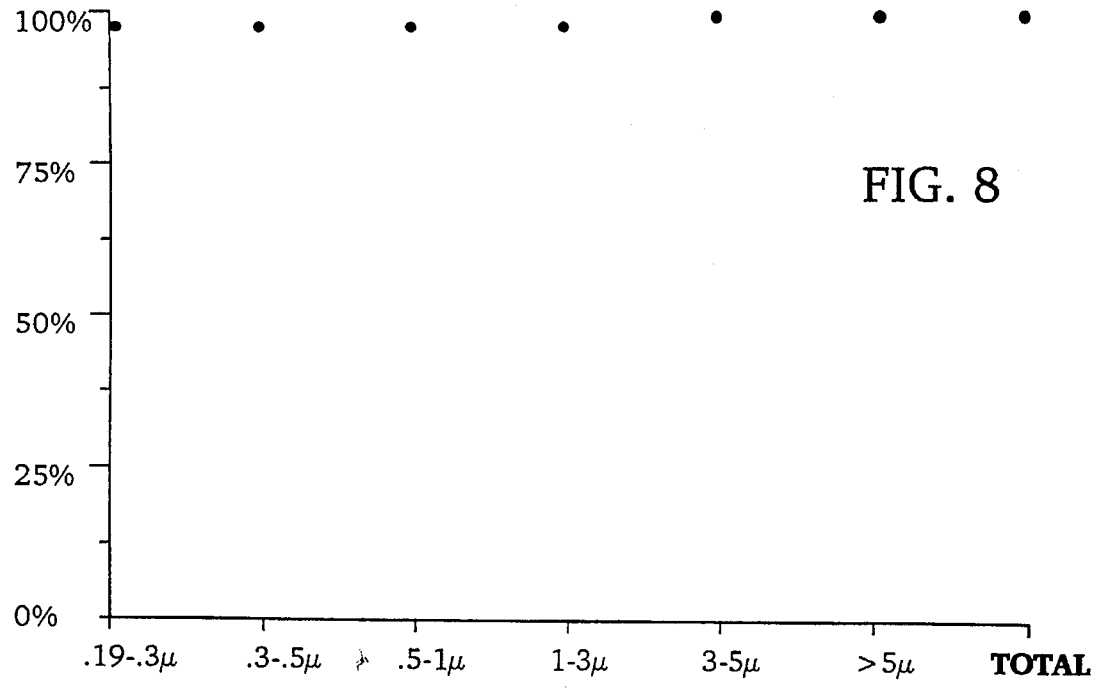
FIG. 8 is a chart of a filter efficiency test using a CHARGED fibrous filter per FIGS. 1, 2, 4.
Figure 9:
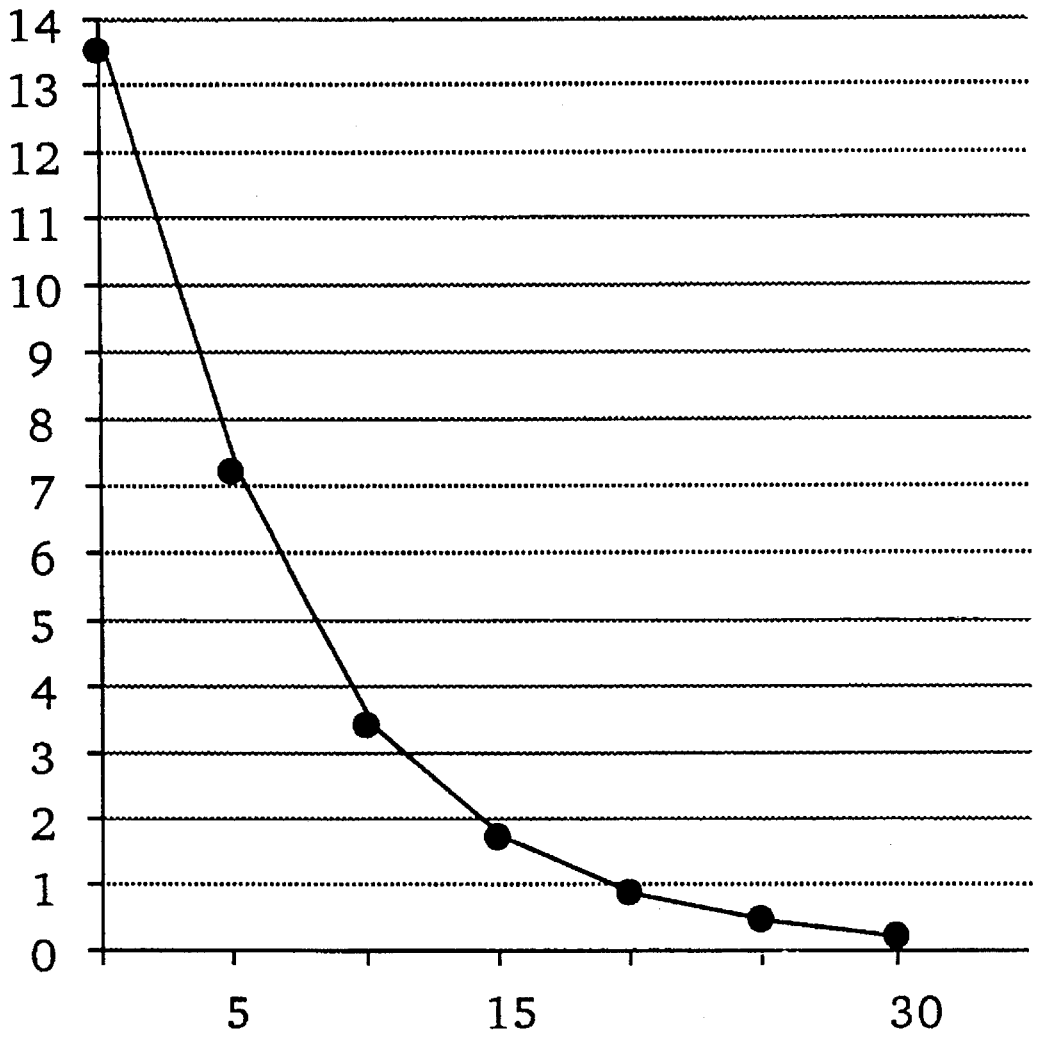
FIG. 9 is a chart of a time lapse filtration test of the filter of FIGS. 1, 2, 4.

These table results are shown in FIG. 8. The electrostatic fields noted in FIGS. 1, 2, 4 were applied.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An electrostatic air filter for use in removing particles from air, comprising:

a filter medium having an upstream side and a downstream side;

means for flowing air through said filter medium in a downstream direction;

an electrode pair including an insulated electrode and a noninsulated electrode positioned adjacent said filter medium on respective upstream and downstream sides of said filter medium, said insulated electrode being covered with insulation to prevent establishment of a conductive path between said insulated electrode and said noninsulated electrode through said filter medium;

means for establishing a potential difference between said insulated electrode and said noninsulated electrode to polarize said filter medium and increase the efficiency of said filter medium in removing particles from said air passing through said filter medium, said establishing means providing said insulated electrode with an insulated electrode polarity selected from an insulated electrode polarity group consisting of a positive polarity and a negative polarity; and means for charging particles in said air upstream of said electrode pair with a charge having the same polarity as said insulated electrode when said insulated electrode polarity is selected from said insulated electrode polarity group consisting of said positive polarity and said negative polarity.

2. The filter as set forth in claim 1 wherein said establishing means further includes means for providing said noninsulated electrode with a polarity selected from a polarity group consisting of a connection to ground and a polarity opposite that of said insulated electrode.

3. The filter as set forth in claim 2 wherein said insulated electrode polarity group further consists of a connection to ground and said charging means includes means for charging said particles in said air upstream of said electrode pair with a polarity opposite that of said noninsulated electrode when said insulated electrode is connected to ground.

4. The filter as set forth in claim 1 wherein said flowing means includes a housing for a room air purifier and a fan.

5. The filter as set forth in claim 1 wherein said establishing means provides a potential difference between said insulated electrode and said noninsulated electrode ranging from about ten to fifty kilovolts DC.

6. The filter as set forth in claim 5 wherein said charging means includes an ion generator capable of operating at a charge ranging from about ten to fifty kilovolts DC.

7. The filter as set forth in claim 1 wherein said insulated electrode polarity is said negative polarity and said charging means provides particles having a negative particle polarity.

8. The filter as set forth in claim 7 wherein said noninsulated electrode is connected to ground.

9. The filter as set forth in claim 7 wherein said insulated electrode is positioned upstream of said-filter medium.

10. The filter as set forth in claim 1 wherein said filter medium in an operational state has an efficiency of at least 99% in removing particles having sizes ranging between 0.19 μm and 0.3 μm at an air flow of 100 cfm and a pressure drop of 0.90 in Wg.

* * * * *

US005549735B1

(12) REEXAMINATION CERTIFICATE (4415th)

United States Patent

Coppom

(10) Number: US 5,549,735 C1

(45) Certificate Issued: Aug. 14, 2001

(54) ELECTROSTATIC FIBROUS FILTER

(75) Inventor: Rex R. Coppom, Longmont, CO (US)

(73) Assignee: Coppom Technologies, Boulder, CO (US)

Reexamination Request:
No. 90/005,846, Oct. 16, 2000

Reexamination Certificate for:

| | |
|---|---|
| Patent No.: | **5,549,735** |
| Issued: | **Aug. 27, 1996** |
| Appl. No.: | **08/257,729** |
| Filed: | **Jun. 9, 1994** |

(51) Int. Cl.[7] ..... B03C 3/155

(52) U.S. Cl. ..... 96/63; 95/78; 96/68; 96/88

(58) Field of Search ..... 95/63, 78; 96/59, 96/63, 66, 68, 70, 69, 88, 223; 422/22, 121, 906, 907

(56) References Cited

U.S. PATENT DOCUMENTS 5,330,559 * 7/1994 Cheney et al. ..... 95/63
5,368,635 * 11/1994 Yamamoto ..... 96/63
5,403,383 * 4/1995 Jaisinghani ..... 96/59
5,540,761 * 7/1996 Yamamoto ..... 96/67
5,647,890 * 7/1997 Yamamoto ..... 96/59

FOREIGN PATENT DOCUMENTS 41-38751 6/1966 (JP) .
49-103823 8/1974 (JP) ..... B03C/3/12

* cited by examiner

*Primary Examiner*—Duane S. Smith

(57) ABSTRACT

The particle collection efficiency of a fibrous filter is significantly increased by imposing a high voltage potential on electrodes placed on either side of the filter. This creates a strong electrostatic field across the filter which electrically enhances the fiber's particle collection ability. The electrostatic field strength, and particle collection efficiency, increase with the voltage employed to establish the electrostatic field. An insulated electrode as the front electrode in combination with a conductive electrode as the rear electrode enables a very high electrical potential to be imposed on the electrodes without resulting in arcing between electrodes. Pre-charging of dust particulates with the same polarity as the insulated electrodes further increase collection efficiency without resulting in a charge buildup in front of the electrodes or a blocking of airflow by particles collecting on the electrodes.

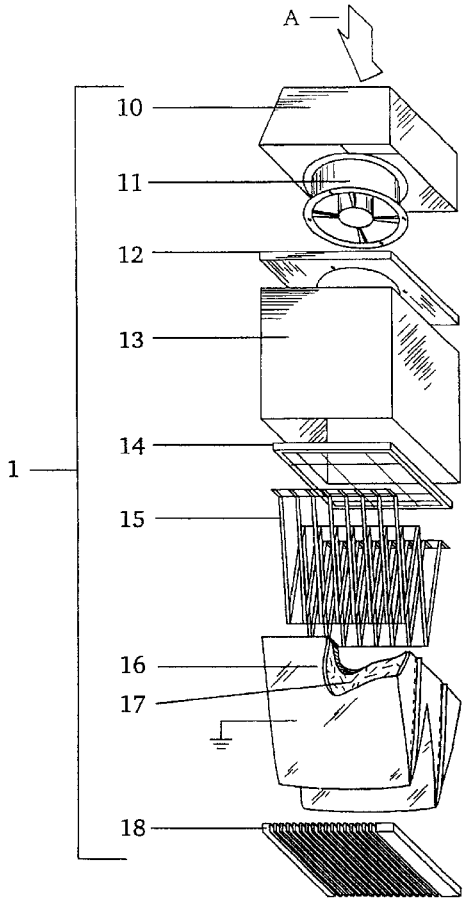

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–10, dependent on an amended claim, are determined to be patentable.

New claims 11–14 are added and determined to be patentable.

1. An electrostatic air filter for use in removing particles from air, comprising:

a filter medium having an upstream side and a downstream side;

means for flowing air *and particles in the air* through said filter medium in a downstream direction;

an electrode pair including an insulated electrode and a noninsulated electrode positioned adjacent said filter medium on respective upstream and downstream sides of said filter medium *in a manner such that an electric potential difference applied between the insulated electrode and the noninsulated electrode will result in an electrostatic field across the filter medium that polarizes the filter medium and such that charges from particles collected on such polarized filter medium can migrate along the filter medium to the noninsulated electrode for neutralization*;

said insulated electrode being covered with insulation to prevent *both arcing and* establishment of a conductive path between said insulated electrode and said noninsulated electrode through said filter medium *at the potential difference applied between the insulated electrode and the noninsulated electrode to polarize the filter medium*;

means for establishing a potential difference between said insulated electrode and said noninsulated electrode to polarize said filter medium *enough to attract and collect both charged particles and uncharged polarized particles* and *thereby* increase the efficiency of said filter medium in removing particles from said air passing through said filter medium;

said establishing means providing said insulated electrode with an insulated electrode polarity selected from an insulated electrode polarity group consisting of a positive polarity and a negative polarity; and means for charging particles in said air upstream of said electrode pair with a charge having the same polarity as said insulated electrode when said insulated electrode polarity is selected from said insulated electrode polarity group consisting of said positive polarity and said negative polarity *so said particles charged with the same polarity as the insulated electrode will neutralize opposite polarity charges that collect on said insulated electrode*.

*11. An electrostatic air filter for use in removing particles from air, comprising:*

*a filter medium having an upstream side and a downstream side;*

*means for flowing air through said filter medium in a downstream direction;*

*an electrode pair including an insulated electrode and a noninsulated electrode positioned adjacent said filter medium on respective upstream and downstream sides of said filter medium;*

*said insulated electrode being covered with insulation to prevent establishment of a conductive path between said insulated electrode and said noninsulated electrode through said filter medium;*

*means for establishing a potential difference between said insulated electrode and said noninsulated electrode to polarize said filter medium and increase the efficiency of said filter medium in removing particles from said air passing through said filter medium;*

*said establishing means providing: (i) said insulated electrode with an insulated electrode polarity selected from an insulated electrode polarity group consisting of a positive polarity and a negative polarity, and a connection to ground; (ii) said noninsulated electrode with a noninsulated polarity selected from a polarity group consisting of a connection to ground and a polarity opposite that of said insulated electrode; and*

*means for charging particles in said air upstream of said electrode pair with a charge having the same polarity as said insulated electrode when said insulated electrode polarity is selected fron said insulated electrode polarity group consisting of said positive polarity and said negative polarity and with a polarity opposite that of said noninsulated electrode when said insulated electrode is connected to ground.*

*12. An electrostatic air filter for use in removing particles from air comprising:*

*a filter medium having an upstream side and a downstream side;*

*means for flowing air through said filter medium in a downstream direction;*

*an electronic pair including an insulated electrode and a noninsulated electrode positioned adjacent said filter medium on respective upstream and downstream sides of said filter medium;*

*said insulated electrode being covered with insulation to prevent establishment of a conductive path between said insulated electrode and said noninsulated electrode through said filter medium;*

*means for establishing a potential difference between said insulated electrode and said noninsulated electrode to polarize said filter medium and increase the efficiency of said filter medium in removing particles from said air passing through said filter medium;*

*said establishing means providing said insulated electrode with a negative polarity; and*

*means for charging particles in said air upstream of said electrode pair with a negative polarity.*

*13. The filter as set forth in claim 12 wherein said noninsulated electrode is connected to ground.*

*14. The filter as set forth in claim 12 wherein said insulated electrode is positioned upstream of said filter medium.*

* * * * *